US008075074B2

(12) United States Patent
Fulton

(10) Patent No.: US 8,075,074 B2
(45) Date of Patent: Dec. 13, 2011

(54) DOOR TO CABINET INTERFACE FOR REFRIGERATOR

(75) Inventor: Timothy A. Fulton, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 1350 days.

(21) Appl. No.: 11/388,557

(22) Filed: Mar. 24, 2006

(65) Prior Publication Data

US 2007/0220916 A1 Sep. 27, 2007

(51) Int. Cl.
*A47B 96/00* (2006.01)

(52) U.S. Cl. ..... 312/405.1; 62/338

(58) Field of Classification Search ..... 312/401, 312/405, 405.1, 406; 62/389, 440, 449, 338, 62/339

See application file for complete search history.

(56) References Cited

U.S. PATENT DOCUMENTS 2,665,414 A * 1/1954 Hubacker et al. ..... 439/31
4,543,800 A 10/1985 Mawby et al. ..... 62/339
4,812,810 A * 3/1989 Query et al. ..... 340/545.3
4,860,551 A * 8/1989 Query ..... 62/140
4,912,942 A * 4/1990 Katterhenry et al. ..... 62/338
5,272,888 A 12/1993 Fisher et al. ..... 62/334
5,768,905 A 6/1998 Oh ..... 62/264
5,787,724 A * 8/1998 Pohl et al. ..... 62/389
5,941,619 A * 8/1999 Stieben et al. ..... 312/223.6
6,584,786 B2 7/2003 Tavolazzi ..... 62/125
6,698,222 B2 3/2004 Sanna et al. ..... 62/229
6,786,058 B2 9/2004 Sanna ..... 62/229
6,868,692 B2 * 3/2005 Choi ..... 62/389
7,281,391 B2 * 10/2007 Marret et al. ..... 62/389

* cited by examiner

*Primary Examiner* — James O Hansen

(74) *Attorney, Agent, or Firm* — Kirk W. Goodwin; Greer, Burns & Crain, Ltd.

(57) ABSTRACT

The present invention provides a refrigerator having a cabinet with a refrigeration compartment defined by surrounding walls and an open side. There is at least one cabinet door arranged to move relative to the cabinet to selectively open and close the open side. At least one component is located in the cabinet door requiring information to be transmitted between the cabinet and the door. A first mating hub is located on one of the surrounding walls of the refrigeration compartment. A second mating hub is carried on the cabinet door, such that when the cabinet door is moved into a closed position relative to the cabinet, the first and second mating hubs will be arranged in alignment. The hubs have terminal connections for transmitting information from one hub to the other when aligned.

15 Claims, 2 Drawing Sheets

DOOR TO CABINET INTERFACE FOR REFRIGERATOR

BACKGROUND OF THE INVENTION

The present invention relates generally to refrigerators and in particular to an interface for the transmission of information between the door and the cabinet of the refrigerator.

Refrigerators typically have one or two doors that may be pivotally secured to the refrigerator cabinet with hinges. It is known to provide components on or in the refrigerator doors that require information or other things, such as water or electrical current, to be moved between the refrigerator and the door.

Oftentimes the transmission of water; electrical power and information is transmitted via conduits and wires that extend between the cabinet and the door, and to allow the door to pivot open and closed, the conduits and wires are directed through the pintle of one or more hinges of the door, such as disclosed in U.S. Pat. No. 4,543,800.

When the wires and conduits are threaded through the hinge pintle, the difficulty that arises is when the swing of the door must be changed, such as from a right hand opening to a left hand opening, and the door hinge must be transferred from one side of the door and cabinet to the other. This requires that the wires and conduits be disconnected and rerouted from one side of the door and cabinet to the other.

Other arrangements are known for transmitting water and electrical power from the cabinet to the door without using conduits that pass through the hinge pintle.

For example, in U.S. Pat. No. 5,768,905, a water conduit in the cabinet terminates above a point where an opening to a reservoir in the door will be located when the door is closed, such that water may be delivered from the cabinet to the door without requiring a conduit through the door pintle.

In U.S. Pat. No. 5,272,888, an ice chute in the cabinet terminates above a point where a continuation of the ice chute is located in the door when the door is closed, such that ice may be delivered from the cabinet to the door.

In U.S. Pat. No. 6,584,786, control means and driver means include signal reception/transmission members, one on the door and one in the cabinet, to transmit information between the door and the cabinet, without requiring wires through the hinge. Electrical current is transmitted between the door and the cabinet via a set of contacts on the cabinet and a set of contacts on the door that engage when the door is closed.

In U.S. Pat. No. 6,698,222, a refrigerator shelf and the refrigerator cabinet are arranged to be able to communicate by means of inductive circuits, to transmit information between the two items, without a direct electrical connection using wires. Communication between the shelf and the cabinet via RF is also disclosed.

In U.S. Pat. No. 6,786,058, an appliance is provided with a control in the cabinet and a user activated control panel on a movable door of the appliance, with information transmitted between the door and the cabinet via an RF signal, without requiring wires extending between the cabinet and the door.

In JP 2003319573, JP2002320348, JP2001128392, JP2001128391 and JP2001033136, power is transmitted between the cabinet and door of a refrigerator via induction, without requiring wiring to extend between the door and the cabinet. In JP2002044847, electrical power is transmitted between the door and the cabinet of a refrigerator via contacts that are magnetically attracted to one another when the door is in the closed position. Wiring does not extend through the door hinge.

SUMMARY OF THE INVENTION

In an embodiment, the present invention provides an arrangement for transmitting information and perhaps other things such as electrical current and water, between a cabinet and a door of a refrigerator, without requiring a transmission line passing through a hinge connection of the door. This will permit the door of the refrigerator to be reversed easily, such as when the opening hand of the door needs to be changed to fit properly in a particular kitchen layout.

The present invention provides a refrigerator having a cabinet with a refrigeration compartment defined by surrounding walls and an open side. There is at least one cabinet door arranged to move relative to the cabinet to selectively open and close the open side. At least one component is located in the cabinet door requiring information to be transmitted between the cabinet and the door. A first mating hub is located on one of the surrounding walls of the refrigeration compartment. A second mating hub is carried on the cabinet door, such that when the cabinet door is moved into a closed position relative to the cabinet, the first and second mating hubs will be arranged in alignment. The hubs have terminal connections for transmitting information from one hub to the other when aligned.

In an embodiment, the first mating hub is located on a top wall of the refrigeration compartment.

In an embodiment, the second mating hub is carried in a cantilevered position on the door.

In an embodiment, the first and second mating hubs include water conduits which align with one another to transmit water from the cabinet to the door.

In an embodiment, the first and second mating hubs include electrical conductors which engage one another in an electrically conducting manner to transmit electrical current from the cabinet to the door.

In an embodiment, the first mating hub includes a fiber optic line and the second mating hub includes a fiber optic line, the two lines being in transmissive alignment when the door is moved into a closed position relative to the cabinet.

In an embodiment, the first mating hub and the second mating hub include a plurality of terminal connections for transmitting a plurality of electrical power, water and information from one hub to the other when aligned.

In an embodiment, the cabinet door is located on a front side of the refrigeration cabinet.

In an embodiment, a refrigerator is provided which comprises a cabinet enclosing a refrigerated compartment defined by side walls, a bottom wall and a top wall. A door selectively closes at least part of one of the walls. An interface unit is carried on the door including a light data transmission receptor. A light data transmitter is positioned in the refrigerated cabinet and is arranged to transmit a light signal to be received by the light data transmission receptor on the interface unit when the door is closed and the transmitter and receptor are aligned. By this arrangement, data can be transmitted from the cabinet to the door via the light data transmitter and the interface unit.

In an embodiment, the interface unit further includes a light data transmitter and the cabinet includes a light data transmission receptor wherein information can be transmitted from the door to the cabinet.

In an embodiment, the interface unit further includes an electrical connection interface to permit transmission of electrical current from the refrigerator cabinet to the door.

In an embodiment, the interface unit further includes a water conduit connection interface to permit transmission of water from the refrigerator cabinet to the door.

In an embodiment, the interface unit is positioned at a top edge of the door and the light data transmitter is positioned in the top wall of the compartment.

In an embodiment, at least one component is located in the cabinet door requiring information to be transmitted between the cabinet and the door.

In an embodiment, a refrigerator comprises a cabinet with a refrigeration compartment defined by surrounding walls and an open side. At least one cabinet door is arranged to move relative to the cabinet to selectively open and close the open side. One or more components are located in the cabinet door requiring information, electrical power and water to be transmitted between the cabinet and the door. A first mating hub is located on one of the surrounding walls of the refrigeration compartment. A second mating hub is carried on the cabinet door, such that when the cabinet door is moved into a closed position relative to the cabinet, the first and second mating hubs will be arranged in alignment. The hubs have terminal connections for transmitting information, electrical power and water from one hub to the other when aligned.

In an embodiment, the first mating hub includes a fiber optic line and the second mating hub includes a fiber optic line, the two lines being in transmissive alignment when the door is moved into a closed position relative to the cabinet.

In an embodiment, the first mating hub is located on a top wall of the refrigeration compartment.

In an embodiment, the second mating hub is carried in a cantilevered position on the door.

In an embodiment, the cabinet door is located on a front side of the refrigeration cabinet.

These and other aspects and details of the present invention will become apparent upon a reading of the detailed description and a review of the accompanying drawings. Specific embodiments of the present invention are described herein. The present invention is not intended to be limited to only these embodiments. Changes and modifications can be made to the described embodiments and yet fall within the scope of the present invention.

DETAILED DESCRIPTION OF THE PREFERRED EMBODIMENTS

In an embodiment, the present invention provides an arrangement for transmitting information between a cabinet and a door of a refrigerator, without requiring a transmission line passing through a hinge connection of the door.

Figure 1:
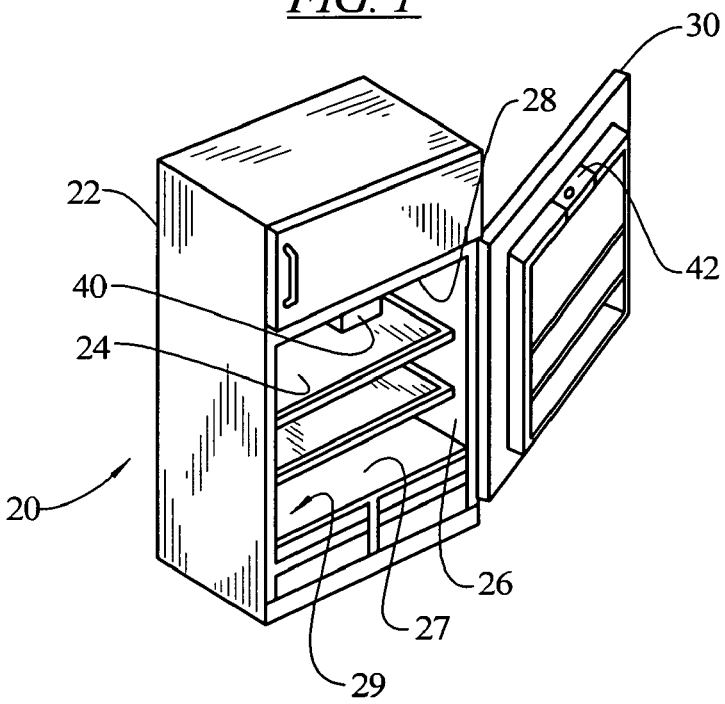
FIG. 1 is a front perspective view of a refrigerator embodying the principles of the present invention.
Figure 2:
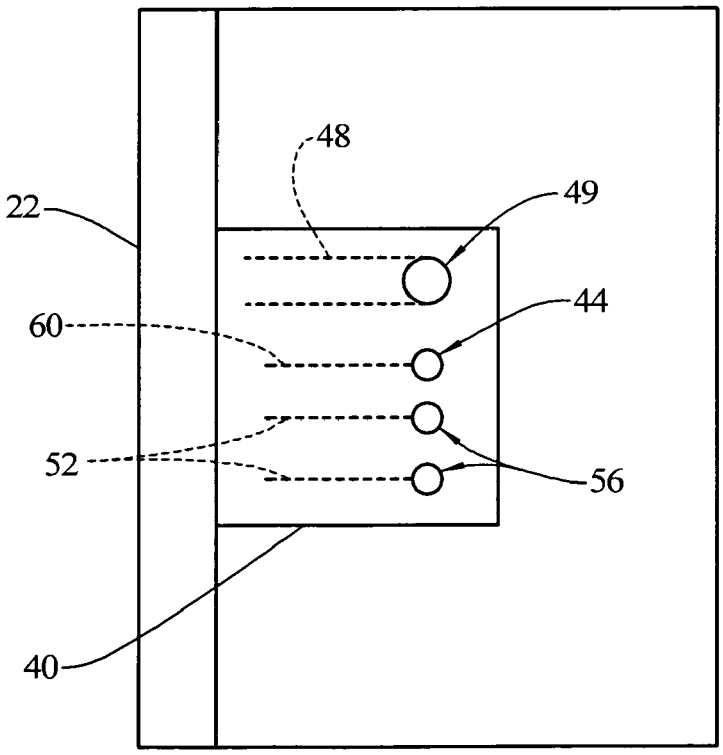
FIG. 2 is a bottom elevational view of the mating hub in the refrigerator cabinet.
Figure 3:
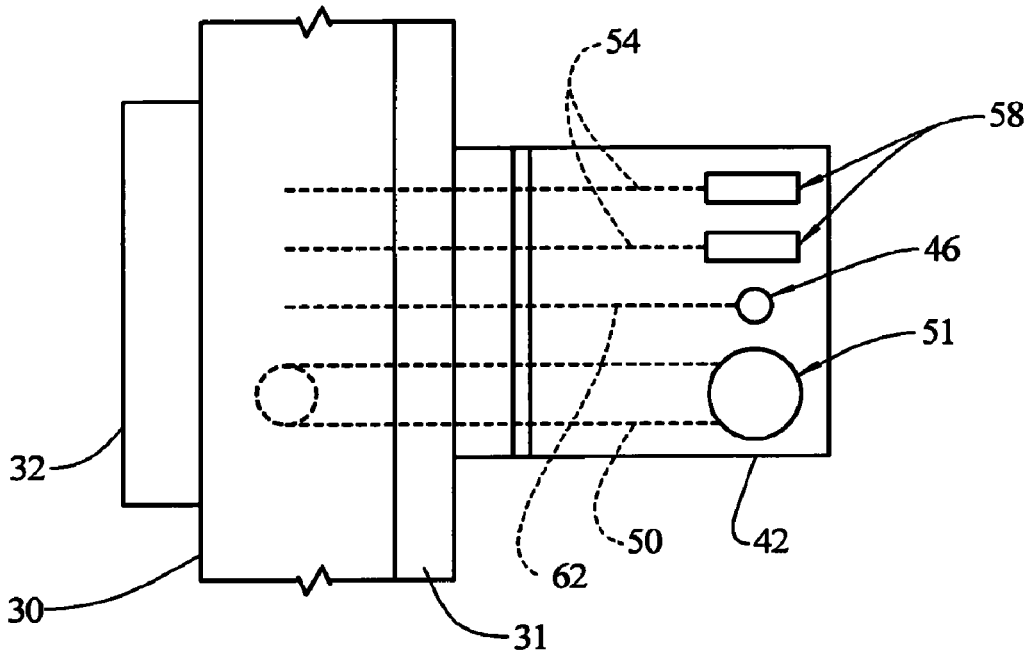
FIG. 3 is a top elevational view of the mating hub carried on the door.

As illustrated in the FIGs., an embodiment of the present invention provides a refrigerator 20 having a cabinet 22 with a refrigeration compartment 24 defined by surrounding walls, such as side walls 26, a bottom wall 27 and a top wall 28, and an open side 29. There is at least one cabinet door 30 arranged to move relative to the cabinet 22 to selectively open and close the open side 29, or at least part of one of the walls 26, 27, 28. In the embodiment of FIG. 1, the door 30 is located at the front side of the refrigerator cabinet 22, but could also be arranged at other sides, such as the top of a side wall other than at the front. A gasket 31 provides a seal between the door 30 and the cabinet 22.

At least one component 32 is located in the cabinet door 30 requiring information to be transmitted between the cabinet 22 and the door. The component 32 may be a water dispenser, input switches, temperature controls, a clock, or other dispensers or information displays or controls. The component 32 may require information to be sent from the cabinet 22 to the component, or from the component to the cabinet. The component 32 may require other things to be transmitted to it, such as water or electrical current.

An interface unit in the form of a first mating hub 40 is located on one of the surrounding walls 26 of the refrigeration compartment 24. An interface unit in the form of a second mating hub 42 is carried on the cabinet door 30, such that when the cabinet door is moved into a closed position relative to the cabinet 22, the first 40 and second 42 mating hubs will be arranged in alignment. The hubs 40, 42 have terminal connections 44, 46 for transmitting information, and perhaps other things, from one hub to the other when aligned.

For example, the first 40 and second 42 mating hubs may include water conduits 48, 50 which have terminal ends 49, 51 which align with one another when the door 30 is closed to transmit water from the cabinet 22 to the door 30. Also, the first 40 and second 42 mating hubs may include electrical conductors 52, 54 which engage one another in an electrically conducting manner to transmit electrical current from the cabinet 22 to the door 30. The conductors 52, 54 may include terminal ends 56, 58 which conductively engage and connect with one another when the hubs 40, 42 are in alignment.

In an embodiment, the first mating hub 40 includes a fiber optic line 60 and the second mating hub 42 includes a fiber optic line 62, the two lines being in transmissive alignment when the door 30 is moved into a closed position relative to the cabinet 22. The fiber optic line 60 in the first hub 40 may include a transmitter 64 such as a lens or other device at the first terminal connection 44 allowing for the transmission of light data in the form of a light signal of modulated pulses, for example, from the fiber optic line 60. The fiber optic line 62 in the second hub 42 may include a receptor 66 such as a lens or other device at the second terminal connection 46 allowing for the reception of light data at the door fiber optic line 62. The transmitter 64 at the first hub 40 may also act as a receptor and the receptor 66 at the second hub 42 may also act as a transmitter so that information can be sent and received in both directions between the cabinet 22 and the door 30.

Figure 4:
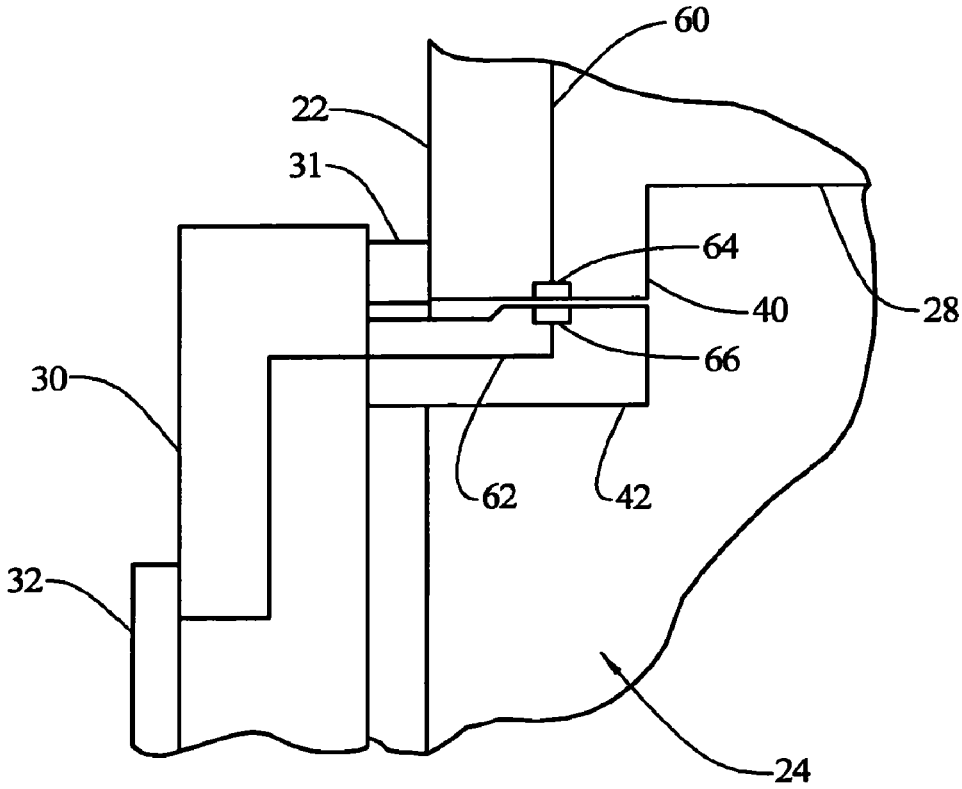
FIG. 4 is a side sectional view of the door and cabinet interface in the region of the mating hubs.

In the embodiment shown in FIGS. 1 and 4, the first mating hub 40 is located on the top wall 28 of the refrigeration compartment 24. The second mating hub 42 is carried in a cantilevered position near a top edge of the door 30, such that the light data receptor 66 aligns with the light data transmitter 64 when the door 30 is closed.

The present invention has been described utilizing particular embodiments. As will be evident to those skilled in the art, changes and modifications may be made to the disclosed embodiments and yet fall within the scope of the present invention. For example, various components could be utilized which are sized or configured differently than illustrated. In other embodiments, different attachment arrangements than those arrangements specifically shown and described could be used. The disclosed embodiments are provided only to illustrate aspects of the present invention and not in any way to limit the scope and coverage of the invention. The scope of the invention is therefore to be limited only by the appended claims.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. A refrigerator comprising:

a cabinet with a refrigeration compartment defined by surrounding walls and an open side, at least one cabinet door arranged to move relative to the cabinet to selectively open and close the open side, at least one component located in the cabinet door requiring information to be transmitted between the cabinet and the cabinet door, a first mating hub located on a downwardly facing surface of a top wall of the refrigeration compartment, a second mating hub carried in a cantilevered position on the cabinet door, such that when the cabinet door is moved into a closed position relative to the cabinet, the second mating hub will project inwardly of the open side of the cabinet and the first and second mating hubs will be arranged in vertical alignment, the mating hubs having terminal connections for transmitting information from one mating hub to the other when vertically aligned, the terminal connections of the first mating hub facing downwardly and the terminal connections of the second mating hub facing upwardly.

2. A refrigerator according to claim 1, wherein the first and second mating hubs include water conduits with terminal ends which vertically align with one another to transmit water from the cabinet to the cabinet door.

3. A refrigerator according to claim 2, wherein the terminal end of the second mating hub water conduit is enlarged with respect to the terminal end of the first mating hub.

4. A refrigerator according to claim 1, wherein the first mating hub includes a fiber optic line and the second mating hub includes a fiber optic line, the two fiber optic lines being in transmissive alignment when the cabinet door is moved into a closed position relative to the cabinet.

5. A refrigerator according to claim 1, wherein the first mating hub and the second mating hub include a plurality of terminal connections for transmitting a plurality of electrical power, water and information from one mating hub to the other when aligned.

6. A refrigerator according to claim 1, wherein the cabinet door is located on a front side of the refrigeration cabinet.

7. A refrigerator comprising:

a cabinet with a refrigeration compartment defined by surrounding walls and an open side, at least one cabinet door arranged to move relative to the cabinet to selectively open and close the open side, at least one component located in the cabinet door requiring information to be transmitted between the cabinet and the cabinet door, a first mating hub located on one of the surrounding walls of the refrigeration compartment, a second mating hub carried on the cabinet door, such that when the cabinet door is moved into a closed position relative to the cabinet, the first and second mating hubs will be arranged in alignment, the first and second mating hubs having terminal connections for transmitting information from one hub to the other when aligned, the first and second mating hubs including electrical conductors with terminal ends which conductively engage and connect with one another in an electrically conducting manner when the cabinet door is moved into the closed position relative to the cabinet to transmit electrical current from the cabinet to the cabinet door.

8. A refrigerator according to claim 7, wherein the first and second mating hubs include water conduits with terminal ends which align with one another to transmit water from the cabinet to the cabinet door.

9. A refrigerator according to claim 8, wherein the terminal end of the second mating hub water conduit is enlarged with respect to the terminal end of the first mating hub.

10. A refrigerator according to claim 7, wherein the first mating hub includes a fiber optic line and the second mating hub includes a fiber optic line, the two fiber optic lines being in transmissive alignment when the cabinet door is moved into a closed position relative to the cabinet.

11. A refrigerator according to claim 7, wherein the first mating hub is located on a top wall of the refrigeration compartment and the second mating hub is carried in a cantilevered position on the cabinet door, such that when the cabinet door is moved into a closed position relative to the cabinet, the first and second mating hubs will be arranged in vertical alignment.

12. A refrigerator according to claim 11, wherein the first and second mating hubs have terminal connections for transmitting information from one mating hub to the other when aligned, the terminal connections of the first mating hub facing downwardly and the terminal connections of the second mating hub facing upwardly.

13. A refrigerator comprising:

a cabinet with a refrigeration compartment defined by surrounding walls and an open side, at least one cabinet door arranged to move relative to the cabinet to selectively open and close the open side, a gasket providing a seal between the cabinet and the cabinet door, one or more components located in the cabinet door requiring information, electrical power and water to be transmitted between the cabinet and the cabinet door, a first mating hub located on a downwardly facing surface of a top wall of the refrigeration compartment, a second mating hub carried on the cabinet door in a cantilevered position, such that when the cabinet door is moved into a closed position relative to the cabinet, the second mating hub will project inwardly from the cabinet door beyond the gasket and the open side of the cabinet and the first and second mating hubs will be arranged in vertical alignment, the first and second mating hubs having terminal connections for transmitting information, electrical power and water from one mating hub to the other when vertically aligned, the terminal connections of the first mating hub facing downwardly and the terminal connections of the second mating hub facing upwardly.

14. A refrigerator according to claim 13, wherein the first mating hub includes a fiber optic line and the second mating hub includes a fiber optic line, the two fiber optic lines being in transmissive alignment when the cabinet door is moved into a closed position relative to the cabinet.

15. A refrigerator according to claim 13, wherein the cabinet door is located on a front side of the refrigeration cabinet.

* * * * *